US006901760B2

(12) United States Patent
Dittmann et al.

(10) Patent No.: US 6,901,760 B2
(45) Date of Patent: Jun. 7, 2005

(54) PROCESS FOR OPERATION OF A BURNER WITH CONTROLLED AXIAL CENTRAL AIR MASS FLOW

(75) Inventors: Rolf Dittmann, Nussbaumen (CH); Christian Steinbach, Neuenhof (CH)

(73) Assignee: Alstom Technology LTD, Baden (CH)

( * ) Notice: Subject to any disclaimer, the term of this patent is extended or adjusted under 35 U.S.C. 154(b) by 0 days.

(21) Appl. No.: 10/665,569

(22) Filed: Sep. 22, 2003

(65) Prior Publication Data

US 2004/0139748 A1 Jul. 22, 2004

Related U.S. Application Data

(62) Division of application No. 09/973,868, filed on Oct. 11, 2001, now abandoned.

(30) Foreign Application Priority Data

Oct. 11, 2000 (DE) ..... 100 50 248

(51) Int. Cl.[7] ..... F02C 9/00

(52) U.S. Cl. ..... 60/773; 60/39.23; 60/39.27; 60/725; 60/737; 431/182; 431/186; 431/188

(58) Field of Search ..... 60/773, 39.23, 60/39.27, 723, 725, 737, 748; 431/182, 186, 188

(56) References Cited

U.S. PATENT DOCUMENTS

| | | | | |
|---|---|---|---|---|
| 2,918,117 A | | 12/1959 | Griffin | |
| 3,938,324 A | | 2/1976 | Hammond et al. | |
| H19 H | | 2/1986 | Carlson | |
| 4,932,861 A | * | 6/1990 | Keller et al. | 431/8 |
| 5,118,283 A | | 6/1992 | Sattelmayer | |
| 5,292,244 A | | 3/1994 | Xiong | |
| 5,307,634 A | | 5/1994 | Hu | |
| 5,402,633 A | * | 4/1995 | Hu | 60/776 |
| 5,404,711 A | | 4/1995 | Rajput | |
| 5,423,674 A | | 6/1995 | Knopfel et al. | |
| 5,461,865 A | | 10/1995 | Snyder et al. | |
| 5,489,203 A | | 2/1996 | Dobbeling et al. | |
| 5,533,329 A | * | 7/1996 | Ohyama et al. | 60/773 |
| 5,638,674 A | | 6/1997 | Mowill | |
| 5,661,967 A | * | 9/1997 | Farkas et al. | 60/774 |
| 5,664,943 A | | 9/1997 | Joos et al. | |
| 5,727,938 A | | 3/1998 | Knopfel | |
| 5,735,687 A | * | 4/1998 | Knopfel et al. | 431/354 |
| 5,791,894 A | | 8/1998 | Dobbeling et al. | |
| 5,884,471 A | | 3/1999 | Anderson et al. | |
| 5,993,199 A | | 11/1999 | Safarik | |
| 6,026,644 A | | 2/2000 | Ito et al. | |
| 6,126,439 A | | 10/2000 | Knopfel et al. | |
| 6,178,752 B1 | * | 1/2001 | Morford | 60/737 |
| 6,216,437 B1 | * | 4/2001 | Hepner et al. | 60/773 |

FOREIGN PATENT DOCUMENTS

| | | |
|---|---|---|
| DE | 44 24 599 A1 | 1/1996 |
| DE | 195 27 453 A1 | 1/1997 |
| DE | 195 45 026 A1 | 6/1997 |
| DE | 197 04 540 C1 | 7/1998 |
| EP | 0 309 034 A1 | 3/1989 |
| EP | 0 321 809 B1 | 5/1991 |
| EP | 0 780 629 A3 | 6/1997 |
| EP | 0 780 629 A1 | 6/1997 |
| EP | 0 945 677 A2 | 9/1999 |
| WO | 93/17279 | 9/1993 |

* cited by examiner

*Primary Examiner*—Ted Kim
(74) *Attorney, Agent, or Firm*—Burns, Doane, Swecker & Mathis, L.L.P.

(57) ABSTRACT

An aerodynamically stabilized premixing burner includes a swirl generator for the production of a rotating combustion air flow, and a device for the introduction of at least one fuel into this combustion air flow. The burner is advantageously provided with a device for the introduction of an axial air flow into the center of the generated rotational flow. This axial air flow is controllable in order to affect the position and intensity of the flame-stabilizing recirculation zone at the burner mouth.

8 Claims, 13 Drawing Sheets

PROCESS FOR OPERATION OF A BURNER WITH CONTROLLED AXIAL CENTRAL AIR MASS FLOW

This application is related and claims priority under 35 U.S.C. § 119 to German Patent Application No. 100 50 248.2, filed Oct. 11, 2000, the entire contents of which are incorporated by reference herein. In addition, this application is a divisional of U.S. patent application Ser. No. 09/973,868 filed on Oct. 11, 2001, now abandoned, the entire contents of which are incorporated by reference herein.

FIELD OF THE INVENTION

The invention relates to a burner for a heat generator.

BACKGROUND OF THE INVENTION

From EP 0 321 809 (US equivalent U.S. Pat. No. 4,932,861), EP 0 780 629 (US equivalent U.S. Pat. No. 5,735,687), WO 93/17279 (US equivalent U.S. Pat. No. 5,402,633), and EP 0 945 677 (US equivalent U.S. Pat. No. 6,178,752), premixing burners are known in which a combustion air flow is introduced tangentially into a burner interior by means of a swirl generator and is mixed with fuel. At the burner outlet, the resulting vortex flow bursts open at a jump in cross section, inducing a recirculation zone which serves to stabilize the flame in operation of the burner.

The axial position of the recirculation zone which arises is of critical importance for the stabilization of the flame, and in its turn is substantially determined by the axial flow in the center of the burner. If this axial flow is too weak, the recirculation zone, and with it the flame, migrates into the burner interior. The danger then exists of a flashback of the flame and a gradual overheating of the burner. If, on the other hand, the axial flow is too strong, the recirculation zone can detach from the burner outlet and become unstable. The consequence can be strong, damaging, combustion pulsations or even an extinction of the flame.

Summarizing, the axial flow in the center of a burner of the aforementioned kind is thus of great importance for stable and safe operation. It is therefore also known to produce a defined axial central flow in such burners by means of a central air injection. Nevertheless, a more or less favorable position of the recirculation zone results even in these burners in different states of operation. Thus, at full load, an axial flow is desirable which is strong enough to hold the flame safely outside the burner. In contrast, at lower loading of the burner the axial flow has to be prevented from driving the recirculation zone impermissibly far from the burner mouth; the axial impulse of the central flow thus has to be smaller.

Solutions known from the state of the art are not capable of setting an optimum axial position of the recirculation zone under all operating conditions.

SUMMARY OF THE INVENTION

According to a first aspect of the invention, a burner for a heat generator comprises a swirl generator for receiving and swirling at least part of a combustion air flow, the swirl generator defining a central burner axis and having an internal space, the swirl generator configured and arranged for tangentially introducing the combustion air flow into the internal space, the internal space defining a cross sectional throughflow area, and means for the introduction of at least one fuel into the combustion air flow; means at a downstream end of the swirl generator for forming an abrupt widening of the cross sectional throughflow area; and an injection device configured and arranged for the introduction of an axial central air flow along the central burner axis, the injection device including an adjustable element configured and arranged for altering a throughflow cross section of the injection device and for the control of the mass flow of the axial central air flow.

According to a second aspect of the invention, a process for operating a burner comprises the steps of providing a burner as described above, and throttling the axial central air flow based upon the burner load, the central flow being strongly throttled at low burner load, and the central flow being little throttled or not throttled at high burner load.

According to a third aspect of the invention, a process of operating a gas turbine comprises the steps of providing a plurality of burners as described above, throttling the axial central air flow based upon the burner load, the central flow being strongly throttled at low burner load, and the central flow being little throttled or not throttled at high burner load; measuring combustion pulsations; and controlling the central flow of each of the plurality of burners depending on the measured combustion pulsations.

The invention will provide a remedy here. The invention has as an object to provide a burner of the kind mentioned above with a central injection device so that the axial impulse of the central air flow is adjustable in all regions of operation to an optimum stabilization and positioning of the flame.

This is attained according to the invention in that the injection device has displaceable elements for changing a flow cross section of the injection device.

An aspect of the invention is thus to provide the burner with a variable geometry of the central injection. It is possible in this manner to match the axial impulse of the central flow to the operating conditions at any given time. This makes it possible to affect the position and intensity of the recirculation zone in a targeted manner. It is thereby possible in a particularly advantageous manner to reduce the amount of air introduced centrally at a low burner load, such that the recirculation zone forms very near to the burner mouth or even partially within the burner interior, so that a superior flame stability results. At high load and high flame temperatures, in contrast, high stability is already intrinsically inherent in the flame. Here the centrally introduced amount of air can be increased such that the recirculation zone comes to be reliably situated a distance downstream of the burner mouth. Thermal overloading of the burner is thereby prevented.

The use of a burner according to the invention is also particularly advantageous when the flow field of the combustion air flow varies due to changing mass flows or temperatures. Precisely such conditions are present in the combustion chambers of gas turbines when the load varies. The states at the compressor outlet and the inflow conditions at the combustion chamber entrance vary considerably, due to different intake air mass flows and compressor outlet pressures. Variations of the position of the recirculation zone thereby arising can be compensated in a burner according to the invention by an adjustment of the geometry of the central injection device.

The invention is concerned with premixing burners, which are well known and familiar per se to the skilled person from the state of the art in the above-cited documents. One aspect of the invention is that it can be immediately combined with all the constructional kinds of swirl generators and burners which are disclosed in the documents cited herein and developed from these documents, and are familiar per se to the skilled person.

The control of the central air flow can be appropriately carried out according to different criteria. Worth mentioning and advantageous here is, for example, a control in dependence on the burner load or on a measured material temperature.

A further operating method results with advantageous operation in the combustion chamber in gas turbines. Here the variable central geometry in combination with the operating concepts of gas turbines with premixers, which are familiar to the skilled person, furthermore serves to ensure operation which is low in pollutants and at the same time stable and free from pulsation. Finally, a variation of the conditions can be set for individual burners in a targeted manner, in order to prevent acoustic resonances in the combustion chamber by a detuning of individual burners.

Still other objects, features, and attendant advantages of the present invention will become apparent to those skilled in the art from a reading of the following detailed description of embodiments constructed in accordance therewith, taken in conjunction with the accompanying drawings.

BRIEF DESCRIPTION OF THE DRAWINGS

The invention of the present application will now be described in more detail with reference to preferred embodiments of the apparatus and method, given only by way of example, and with reference to the accompanying drawings, in which.

DETAILED DESCRIPTION OF THE INVENTION

Figure 1:
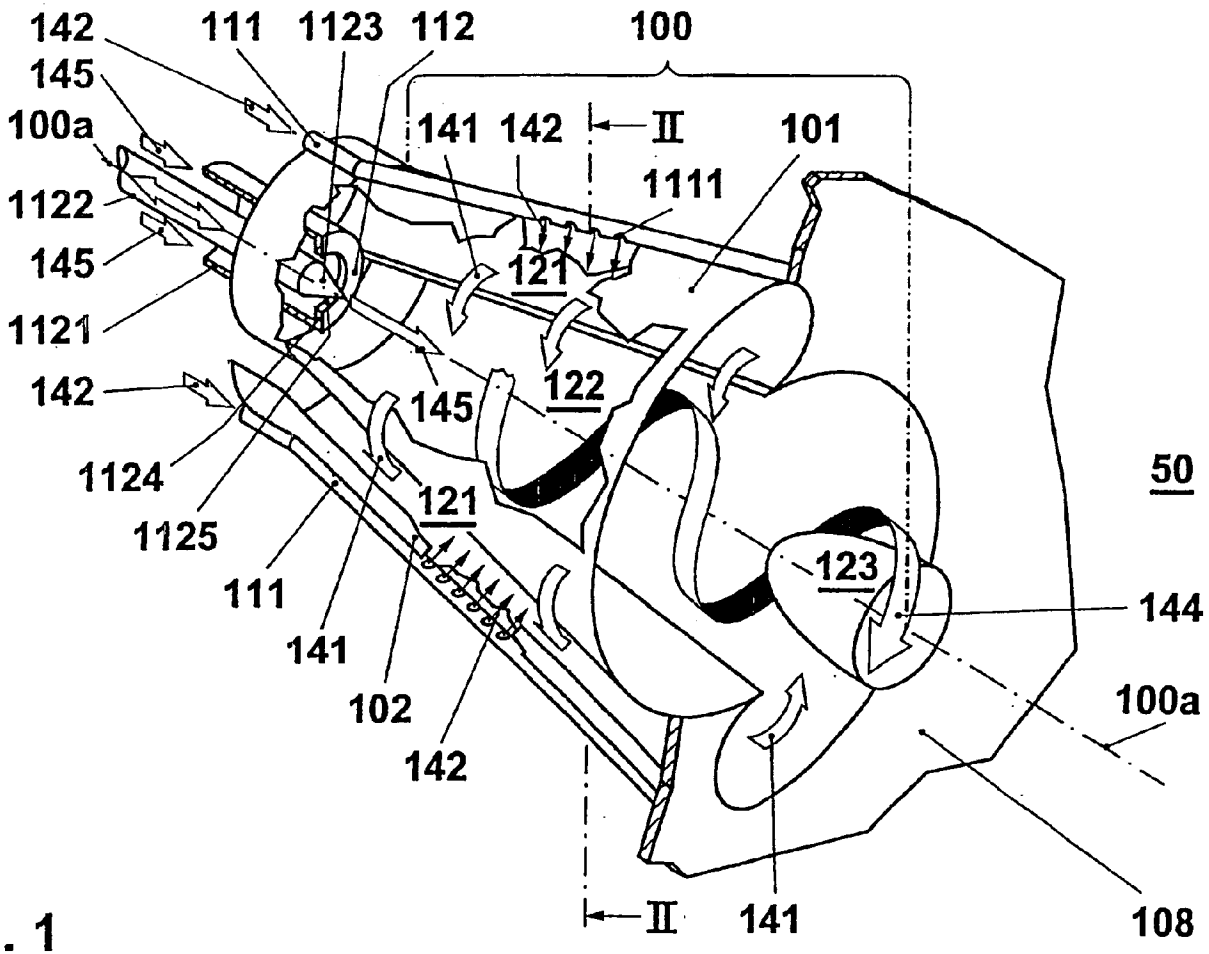
FIG. 1 illustrates a perspective view, with portions broken away, of a burner in accordance with the present invention.

Referring to the drawing figures, like reference numerals designate identical or corresponding elements throughout the several figures.

Figure 2:
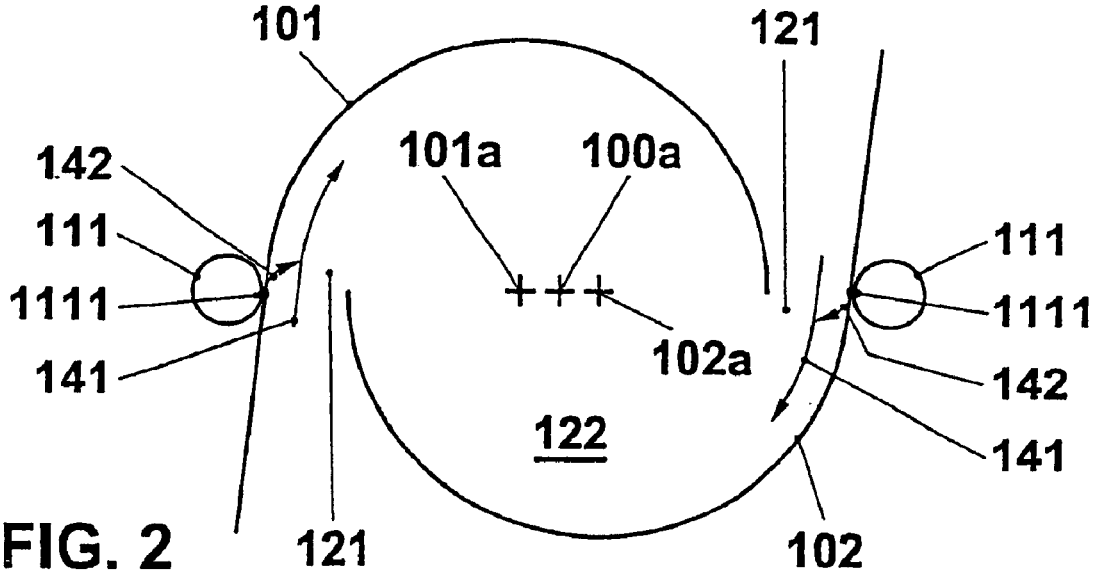
FIG. 2 diagrammatically illustrates a cross-sectional view of the burner of FIG. 1, taken at line 11—11.
Figure 3:
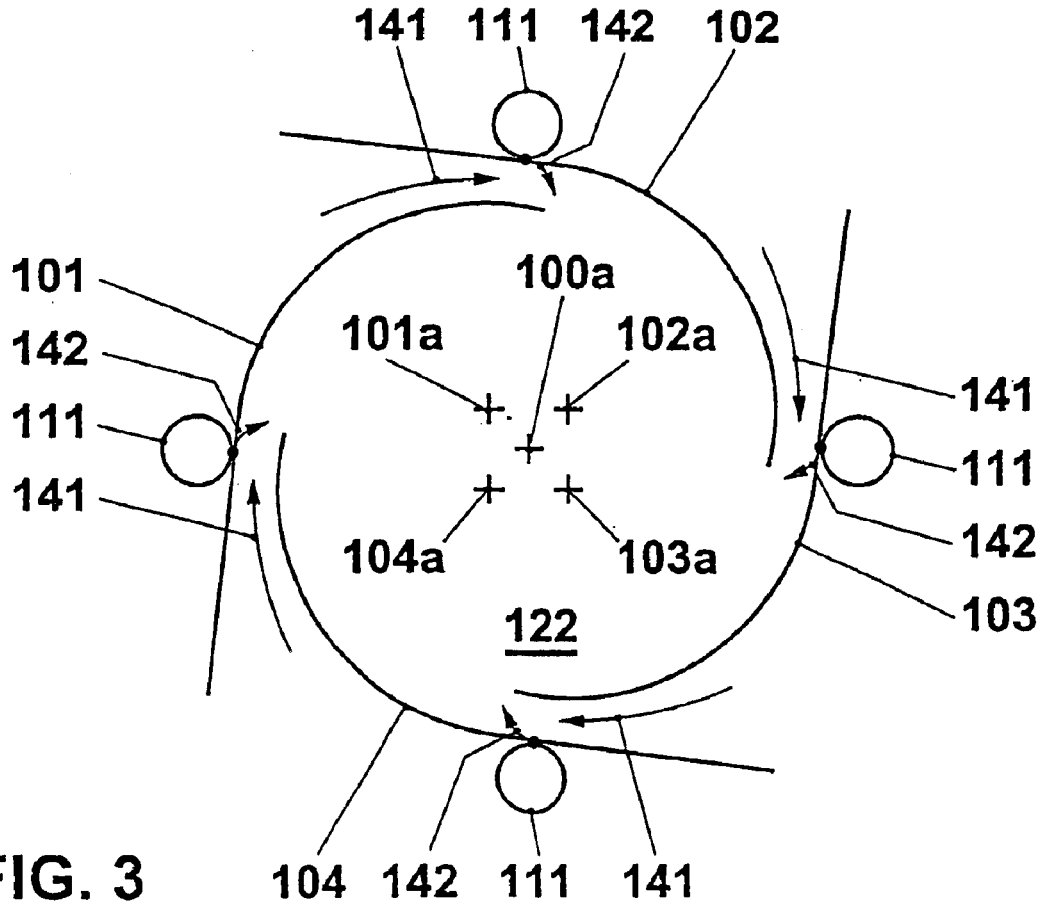
FIG. 3 diagrammatically illustrates a cross-sectional view of a variant of the burner of FIG. 1, taken at line II—II.

As a first preferred embodiment of the invention, a premixing burner is shown in FIG. 1, similar to that known from EP 0 321 809. The burner includes a swirl generator 100, formed by two conical partial members 101, 102, for a combustion air flow. It can be seen from the cross section shown in FIG. 2 that the partial members 101 and 102 are arranged with their axes 101*a* and 102*a* laterally and oppositely offset with respect to the burner axis 100*a*. Tangential inlet slots 121 are formed between the two partial members because of this lateral offset of the partial members. A combustion air flow 141 flows through the tangential inlet slots 121 and substantially tangentially into the internal space 122 of the swirl generator. It is of course also an aspect of the present invention to embody such a swirl generator with another number of partial members; a completely analogous structure is shown in FIG. 3 with, for example, four swirl generator partial members 101, 102, 103, and 104, with the mutually offset axes 101*a*, 102*a*, 103*a*, 104*a* of the partial members.

Again referring to FIG. 1, a swirl flow 144 is formed in the interior of the swirl generator, with its axial flow components facing toward a downstream mouth of the swirl generator. The partial members 101, 102 border on a downstream end of the swirl generator at a front plate 108. The front plate 108 usually forms the end wall of a combustion space 50, and is frequently cooled in a manner which is not shown in the Figure. The internal space 122 of the swirl generator has substantially the shape of a conical frustum (frustocone), widening from an upstream to a downstream end of the swirl generator or burner. The axial flow cross section thus formed has an abrupt widening of the cross section at a downstream end, at the opening into the combustion space 50. A breakdown of the vortex flow 144, and the formation of a recirculation zone 123 in the region of the burner mouth, take place due to the jump in cross section.

A fuel is supplied in a suitable manner to the combustion air flow in the swirl generator. In the embodiment example, fuel ducts 111 are arranged along the partial members in the region of the tangential inlet slots 121, in the axial direction of the swirl generator. Rows of fuel outlet bores 1111 can be seen in the embodiment example. A fuel 142 is supplied via the fuel ducts 111, and flows via the fuel outlet openings 1111 into the interior space 122 of the swirl generator 100. This kind of fuel admixing is frequently and preferably used for gaseous fuels. Intensive mixing of the fuel 142 with the tangentially inflowing combustion air 141 takes place in the interior space of the swirl generator. A very homogeneous mixture of air and fuel is present in the swirl flow 144 at the outlet from the burner into the combustion space 50.

A flame from the premixed air-fuel mixture can be stabilized in the region of the recirculation zone 123. Due to the good premixing of air and fuel, this flame can be operated, with the prevention of stoichiometric zones and the accompanying formation of "hot spots", with a quite high air excess: as a rule, air numbers of two and more are found at the burner itself. Because of the comparatively cool combustion temperatures, very low emissions of nitrogen oxides can be attained with such burners without expensive exhaust gas after-treatment. Because of the good premixing of the fuel with the combustion air and a good flame stabilization by means of the recirculation zone, a good degree of oxidation furthermore occurs in spite of the low combustion temperatures, and thus also low emissions of partially and completely uncombusted fuel, and in particular of carbon monoxide and uncombusted hydrocarbons, but also other undesired organic compounds. Furthermore, the purely aerodynamic flame stabilization due to the breakdown of the vortex flow 144 ("vortex breakdown") is found to be advantageous. Because mechanical flame baffles are dispensed with, no mechanical components come into contact with the flame. The feared failure of mechanical flame baffles due to overheating, with possible subsequent serious accidents to machine sets, is thus excluded. Furthermore, apart from radiation, the flame loses no heat to cold walls. This additionally contributes to equalization of the flame temperature and thus low pollutant emissions and good combustion stability.

A critical factor for the operating performance of such a burner, as given in the Figure, is the position of the recirculation zone 123. This is furthermore essentially determined by the swirl number, roughly speaking, the ratio of the peripheral component to the axial component of the vortex flow 144: if the rotational speed of the vortex flow 144 is large, a wide recirculation zone is formed. Under these conditions, a robust recirculation zone is formed, situated near the burner opening, and thus a stable combustion zone is formed in operation. These are conditions which are desired in the interest of a good flame stability at low burner loads and thus high burner air numbers, and which also are necessary for the stabilization of the flame, burning at comparatively low temperatures. On the other hand, at high swirl numbers of the combustion air flow, a region of low pressure forms along the burner axis and, as it were, sucks the recirculation zone, and with it the flame, into the burner interior. This is, however, undesired at high burner loads. At full load of this burner, this operates with air numbers in a region of 2, in the extreme case, even still under fuel-rich conditions, for example with air numbers of 1.7, 1.5 or even 1.3, but air numbers being attained in each case in the region between 2.5 and 2, preferably about 2.3. The combustion zone therefore clearly has higher temperatures than in the partial load region, in which burner air numbers of 3 or 4 appear, and is itself substantially more stable. A recirculation zone which is so pronounced is thus not required at high loads. There exists on the contrary the danger that hot gas is sucked out of the combustion zone along the burner axis and into the burner. Such a flashback can on the one hand endanger the integrity of the burner, and in the extreme case that of a whole machine set. On the other hand, a flip-flop effect of the flame between two combustion modes inside and outside the burner can build up. Furthermore, a combustion zone spread over a larger space is desired for a high load.

Summarizing, it would thus be established that here a smaller swirl number of the vortex flow 144 is desirable and realizable, which however again limits the operating region to small loads. In order to reduce the danger of flame flashback, it is also known to introduce an axial air flow centrally into the burner, again negatively affecting the partial load behavior of the burner, since the recirculation zone is driven out of the burner mouth. Lastly, the constructionally predetermined flow parameters of the combustion air flow must always represent a compromise, not least because of the fact that, for example, when used in gas turbines the inflow conditions of the combustion air to the burner vary strongly with respect to the mass flow, the temperature, and the pressure, so that in any case it is difficult to provide a defined combustion air flow.

Here the invention proposes to introduce an axial central flow 145 into the center of the burner, along the burner axis or the swirl generator axis 100*a*. The central flow is made variable for matching to the operating conditions. In a first preferred variant, an injection device 112 is situated centrally on the head end of the burner, thus at the upstream end. The injection device shown here includes a throughflow member 1121. This is substantially a hollow-bored cylinder with an open end and an end which has a floor 1124. The floor 1124 has an opening 1125 whose diameter is smaller than the internal diameter of the cylinder bore. The throughflow member 1121 ends with the blunt open side at an inflow, that is, upstream, end of the burner or of the swirl generator 100, while the floor 1124 faces with its opening toward the interior 122 of the burner.

An air stream which flows from the inflow side toward the burner is hereby largely conducted through the tangential inlet slots 121 tangentially into the burner as combustion air 141; however, a partial stream, dependent on the throughflow cross section of the injection device, flows as an axial air flow 145 along the burner axis 100*a* into the center of the burner, and by the additional axial impulse affects the axial position of the recirculation zone 123. An adjustable central member 1122 is inserted coaxially into the throughflow member 1121. This member 1122 tapers at one end with a cone 1123. This cone projects at least in an axial position of the central member into the opening of the floor of the throughflow member. The cone 1123 obstructs the opening to different extents by an axial adjustment of the central member 1122, and thus defines the narrowest throughflow cross section of the injection device 112. The axial central flow 145 can be controlled by an axial adjustment of the central member, which serves as a control member, and thereby also the position and intensity of the recirculation zone 123 can be altered. The embodiment according to the invention of the premixing burner, known per se, thus makes it possible to match the central flow to the operating conditions of the burner. The stable and safe operating region of the burner is thus once more substantially widened.

Figure 4:
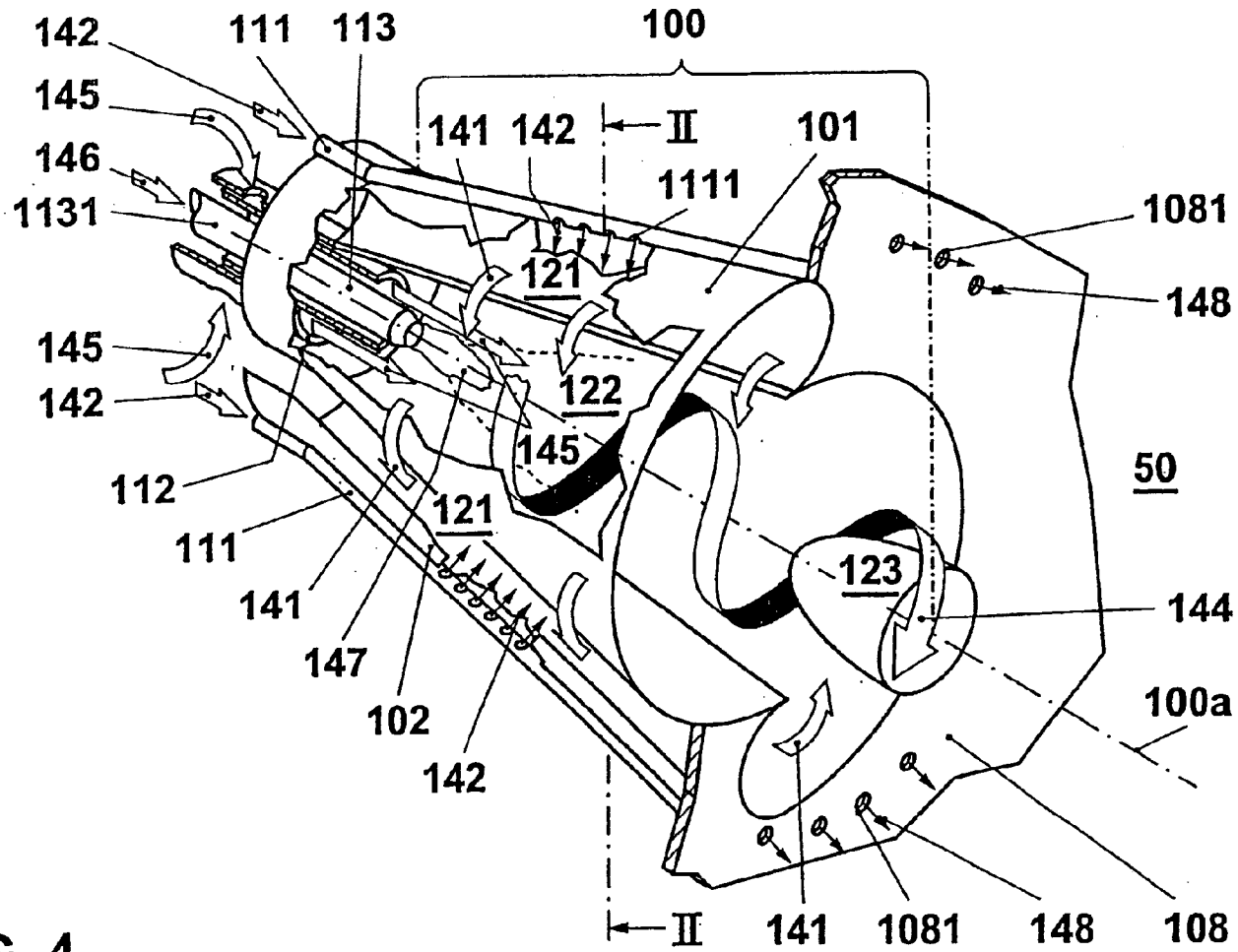
FIG. 4 illustrates a perspective view, with portions broken away, of another embodiment of a burner in accordance with the present invention.

In the premixing burners to which the invention preferably finds application, fuel is frequently also supplied centrally, this fuel supply then finding application both as an alternative and as a supplement to the above-described fuel supply via the ducts 111. Such a burner is shown in FIG. 4. In essential elements, particularly with respect to the swirl generator 100 and the supply of the fuel 142, the burner is completely identical to the burner shown in FIG. 1, so that a detailed description is superfluous, and the following statements can be limited to the differences of this second preferred embodiment. On the one hand, film cooling bores 1081 can be seen on the front segment 108; cooling air 148 flows through them to cool the front segment. Furthermore, a central fuel nozzle 113 is situated on the head side, i.e., at the upstream end, of the swirl generator. Liquid fuel or so-called pilot gas is usually introduced via such a central nozzle into the combustion air flow for the fuel gas operation of the burner in the lowest partial load region; both can also be combined. The fuel 146 to be introduced centrally is supplied to the fuel nozzle 113 via a fuel duct 1131. A fuel cone 147, for example, a liquid fuel spray which expands from the central fuel nozzle 113 into the interior 112 of the swirl generator and which gradually mixes with the swirl flow 144 further downstream, is shown in the embodiment example in FIG. 4.

Figure 5A:
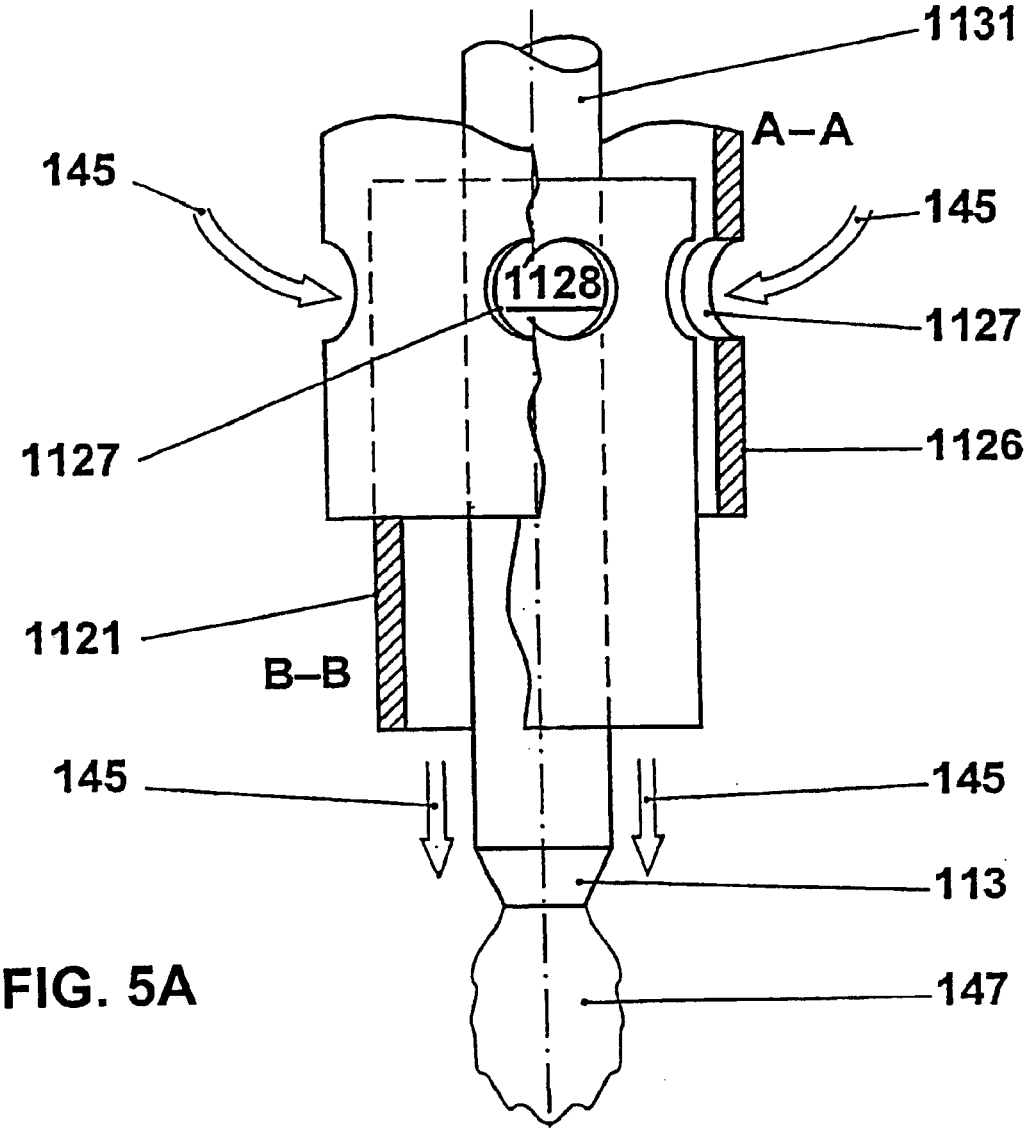
FIG. 5*a* illustrates portions of the burner of FIG. 4, at an enlarged scale, taken at line lines B—B (left side) and A—A (right side) in FIG. 5*b*.
Figure 5B:
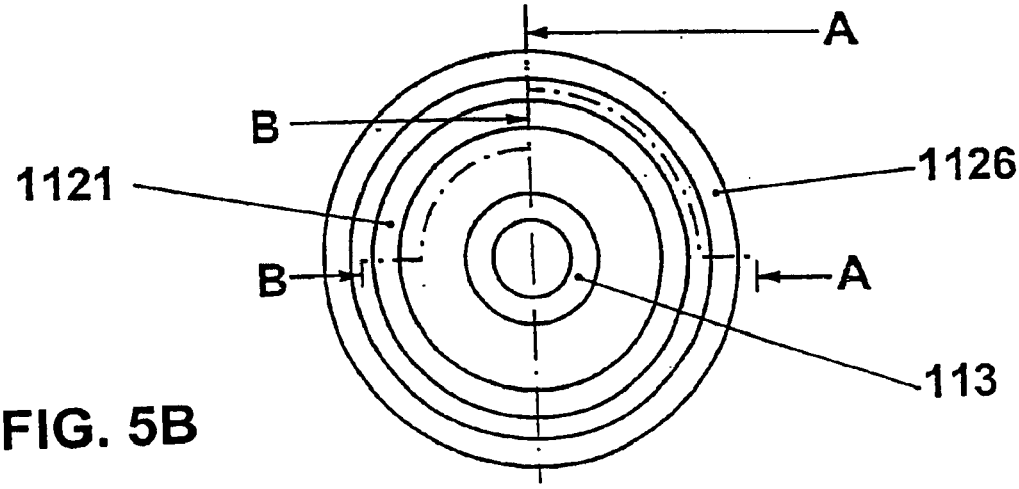
FIG. 5*b* illustrates an end view of the portions of a burner illustrated in FIG. 5*a*.

Usually in the real embodiment of such a burner, as shown in FIG. 4, in gas operation the main fuel is supplied as a fuel 142, as so-called premix gas. The central fuel supply can be used in order on the one hand to supply the abovementioned pilot gas. Furthermore, it is known to embody such burners as "dual fuel" burners, which can be operated both with gaseous and also with liquid fuels; in this case, a central liquid fuel nozzle finds application in practice. It is also known to implement both liquid fuel nozzles and also pilot gas feeds in the head region of a burner. Besides this, nozzles for water or steam injection are frequently found in the head region of the burner, and are frequently used in order to attain a further reduction of nitrogen oxides emission during oil or pilot gas operation of the burner. In such cases very restricted space conditions are sometimes present in the head region, making impossible the use of a central air supply of the kind shown in the first preferred embodiment in FIG. 1. In the second preferred embodiment a central air supply 112 arranged annularly around the fuel nozzle is therefore used. This is shown in detail in FIGS. 5*a* and 5*b*. The fuel duct 1131 with the fuel nozzle 113 is arranged with a substantially annular throughflow member 1121. The throughflow member 1121 is provided with a number of inner control bores 1128, arranged concentrically in an outer member 1126. The outer member 1126 is provided with a number of outer control bores 1127, an inner control bore 1128 of the throughflow member 1121 being allocated to each outer control bore 1127 of the outer member 1126. The central flow flows through pairs of control bores into the annular gap formed between the fuel duct 1131 or fuel nozzle 113 and the throughflow member 1121, and thence axially out into the internal space 122 of the swirl generator. The outer member 1126 and the throughflow member 1121 are arranged to be rotatable and/or axially displaceable with respect to one another. The degree of overlap of inner control bores 1128 and outer control bores 1127, and thus also the throughflow cross section and the mass flow of the central flow 145, can thereby be varied.

Figure 6:
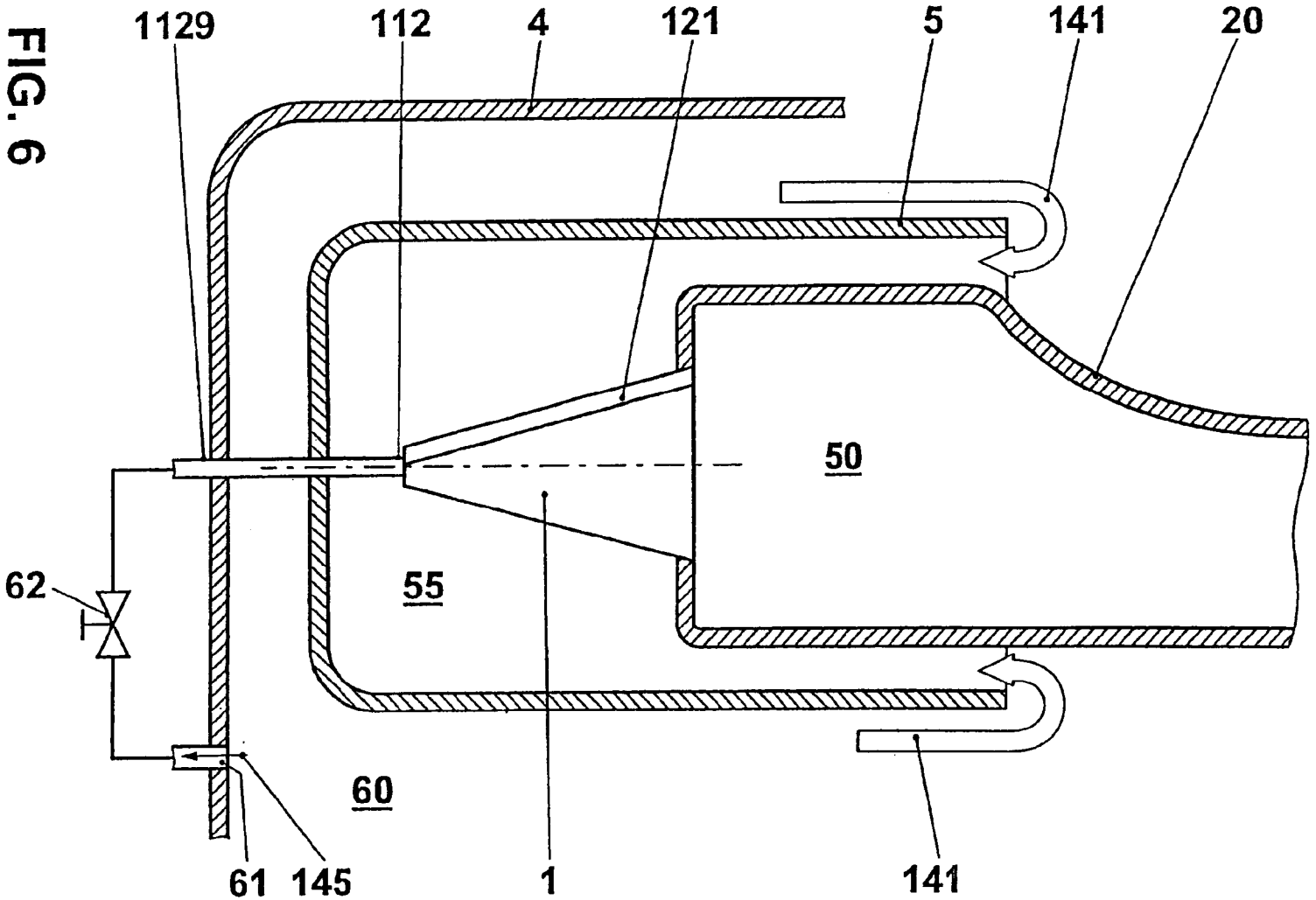
FIG. 6 illustrates portions of a turbine in accordance with the present invention.

A further preferred embodiment is shown in FIG. 6. The burner 1 is arranged on a combustion chamber 20, for example, of a gas turbine, and opens into a combustion space 50. Air flows from a compressor (not shown) into an air chamber 60, which is enclosed by a housing 4. A burner hood 5 is arranged within the housing 4, and further encloses the burner 1. A plenum 55 is formed within the burner hood, and is in fluid connection with the air chamber 60. A combustion air flow 141 flows out of the air chamber 60 into the plenum 55, and from there through tangential inlet slots into the interior of the burner 1, where this air forms a swirl flow in the manner described hereinabove, and is mixed with fuel. The burner is provided with a central injection device 112 in the manner described hereinabove. The central injection device is connected to a central air supply duct 1129. The air chamber 60 is provided with a bypass duct 61. The bypass duct 61 and the central air supply duct 1129 are connected together such that a central air flow 145 can flow from the bypass duct 61 to the central air supply duct 1129. An adjustable throttle element 62 is arranged in this flow path as a control element for the central air flow 145. Thus the central air flow can likewise be varied as described above, and can be matched to the load conditions of the burner. In contrast to the embodiments of the controllable central air injection shown in FIGS. 1 and 4, the embodiment example shown here requires on the one hand an increased apparatus cost, since a duct system has to be arranged; on the other hand, the mechanically comparatively sensitive control element can be arranged at a suitable place less subject to thermal load.

Figure 7:
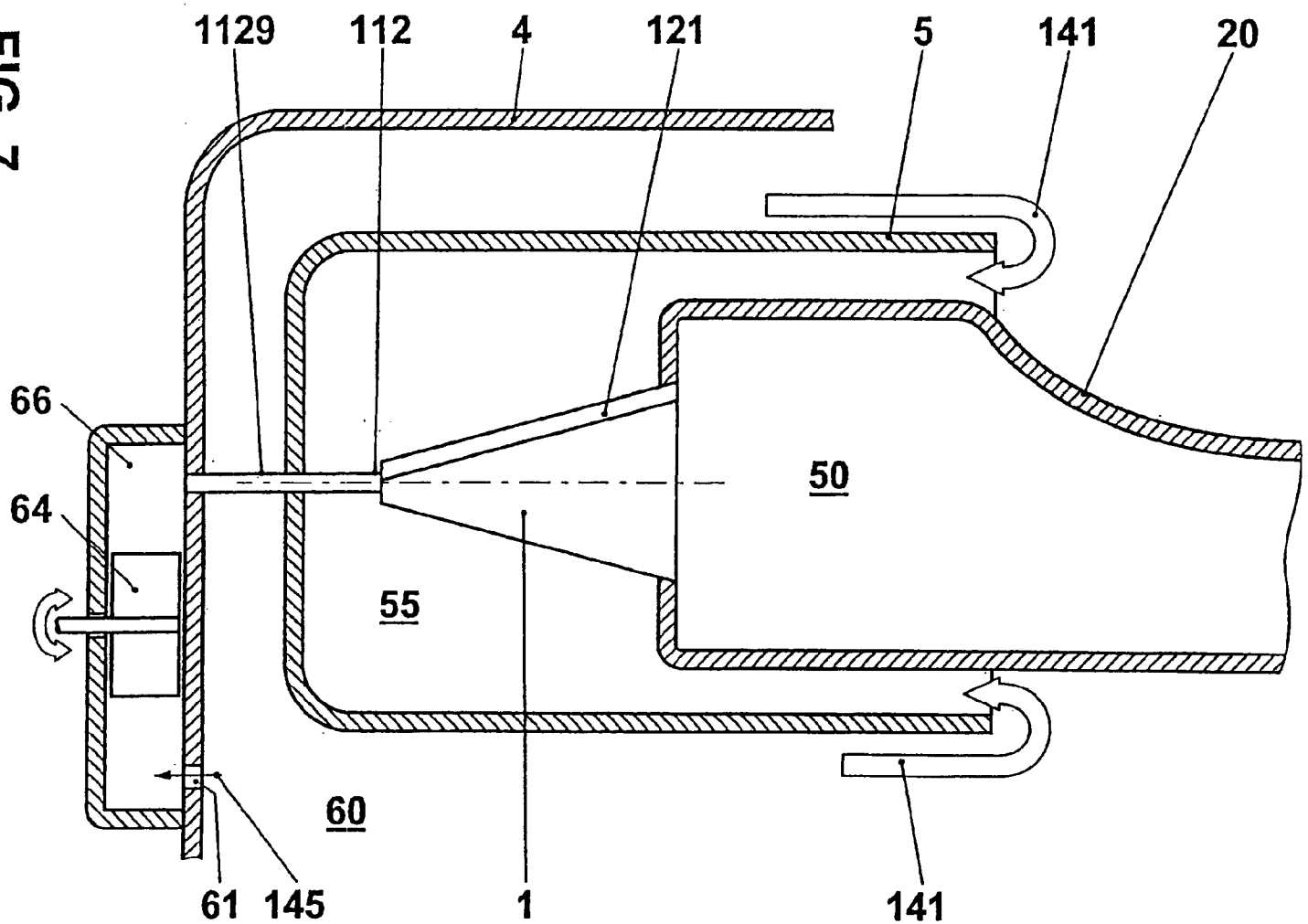
FIG. 7 illustrates portions of another turbine in accordance with the present invention.

A special embodiment of the central air supply with a control element is shown in FIG. 7. Both the air bypass 61 and also the central air supply duct 1129 open into an fluid conduit space 66. A throttle valve 64 is arranged within the fluid conduit space. This is mounted to rotate around an axis, as indicated by the arrow in the drawing. The free flow cross section of the fluid conduit space can be changed by a rotation of the throttle valve 64, resulting in a variation of the central air flow 145.

Based on the radial pressure equilibrium which is given by the known equation:

$$w^2/r=\rho\cdot dp/dr$$

where w is the circumferential speed, r is the distance from the axis of a swirl flow, and p is the static pressure, there is always a reduced pressure in the center of a swirl flow. Embodiments without a burner hood 5 would therefore also be conceivable in principle.

Burners are familiar to the skilled person in different constitutions, which differ in specific embodiment from the burners shown in FIGS. 1, 4, 6, and 7, which include a conical swirl generator. Nevertheless, all these burners are constructed according to a common principle: they have a swirl generator in the form of a hollow body with a longitudinal section which encloses a swirl generator internal space. The swirl generator furthermore has inlet slots which extend in the direction of the swirl generator long axis, or inlet openings arranged in the direction of the long axis and having a throughflow cross section substantially predetermining a tangential flow direction. Combustion air flows through these inlet openings with a strong tangential speed component into the swirl generator internal space, and constitutes there a swirl flow with a certain axial component directed toward the burner mouth in the combustion space. The axial flow cross section of the swirl generator internal space then widens out toward the burner mouth, at least in the region of the air inlet openings. This constitution is favorable for attaining a constant swirl number of the swirl flow in the swirl generator internal space with an increasing combustion air mass flow in the direction of the swirl generator axis. Furthermore these burners have means to introduce fuel into the combustion air flow, which is mixed as homogeneously as possible with the swirled combustion air in the swirl generator and in a mixing zone, for example a mixing pipe, which can optionally be arranged downstream of the swirl generator. A jump in cross section of the axial flow cross section is present at the exit from the burner into the combustion space. There occur here a breakdown of the swirl flow and the formation of a central recirculation zone, which can be used for the stabilization of a flame, as already expressly described above.

It is known from U.S. Pat. No. 5,735,687 (which is in the patent family including EP 0 780 629), which document is incorporated into the present application by reference in its entirety, to arrange a mixing pipe downstream of the swirl generator of a burner. The embodiment of the invention with such a burner is shown by way of example in FIG. 8. A mixing section 200 is arranged downstream of a conical swirl generator 100, whose structure and function is not discussed in further detail here. The swirl generator is secured to a holder ring 210. A transition element 220 is furthermore arranged in the holder ring 210, and is provided with plural transition channels 221 which transfer the swirl flow 144 generated in the swirl generator 100 from the inflowing combustion air into the mixing section without a sudden change of cross section. The mixing pipe 230 proper is arranged downstream of the transition element. A further homogenization of the combustion air and fuel, if necessary, takes place in the mixing pipe.

Based on the uniform preparation of an ignitable mixture over the whole flow cross section of the mixing pipe, the danger exists of a flame flashing back along the low-impulse wall boundary layers in the mixing pipe. The mixing pipe is therefore provided with wall film bores 231 running at an acute angle to the burner axis. An air mass 150 flows through these into the mixing pipe and forms a wall film there. This flashback is effectively prevented by the acceleration or diminution of the wall boundary layers on the one hand, and the displacement of ignitable mixture from the low-impulse regions on the other hand. The mixing pipe 230 is provided at the opening into the combustion space 50 with a breakaway edge 232 which likewise stabilizes the form and position of the recirculation zone 123 forming at the burner mouth. The mixing pipe is fastened to a front segment 108 which at the same time forms a combustion space wall and which in this example is impact cooled by means of impact cooling sheets 109 and impact cooling air 149.

Figure 8:
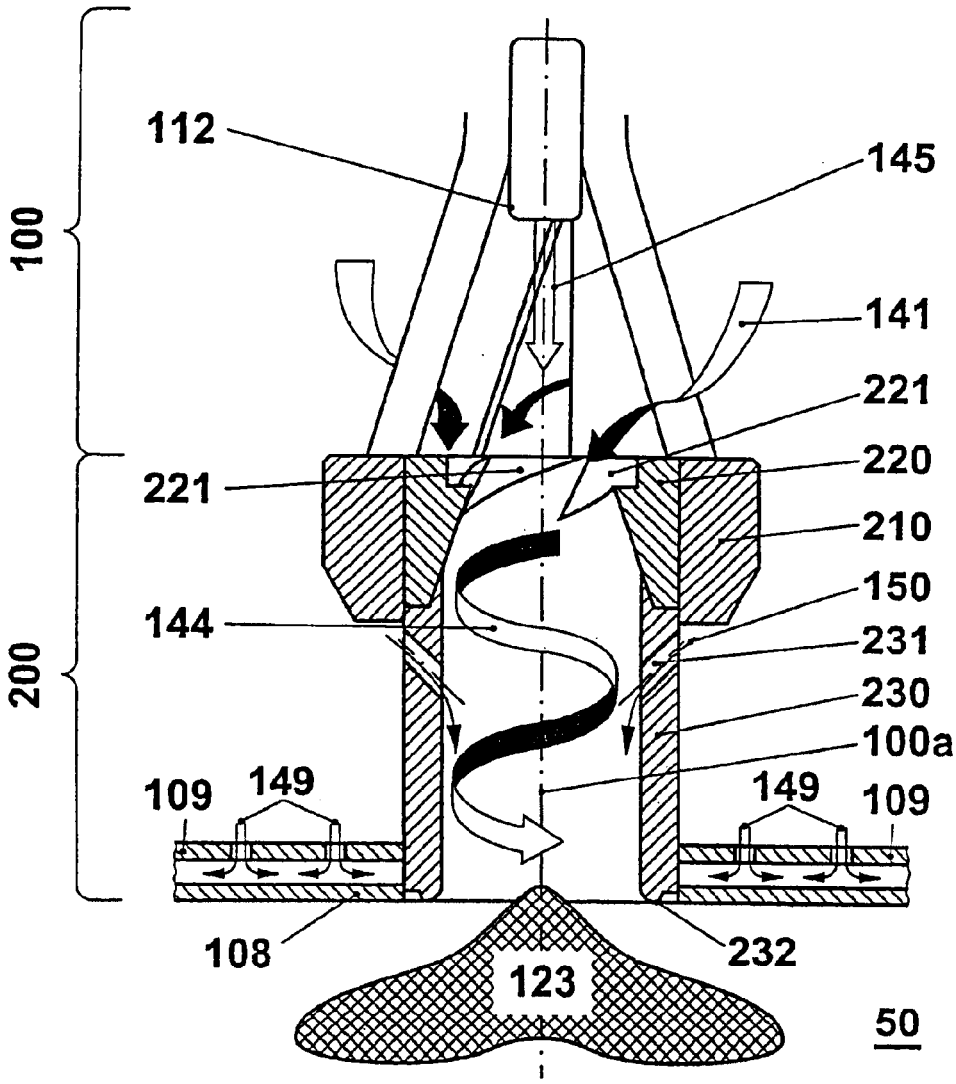
FIG. 8 illustrates yet another embodiment of a burner in accordance with the present invention, including a mixing tube.

Besides the danger of flashback along the wall boundary layers, there also exists here the danger of a flashback of the flame along the burner axis 100*a* under high load, or the danger of the recirculation zone 123 floating away with flame instabilities at low load. In order to prevent this, the burner shown in FIG. 8 is also equipped with a controllable injection device, not expressly shown, for an axial central flow 145, which operates as in the embodiment examples described hereinabove. This can of course also be combined with a central fuel nozzle.

Figure 9:
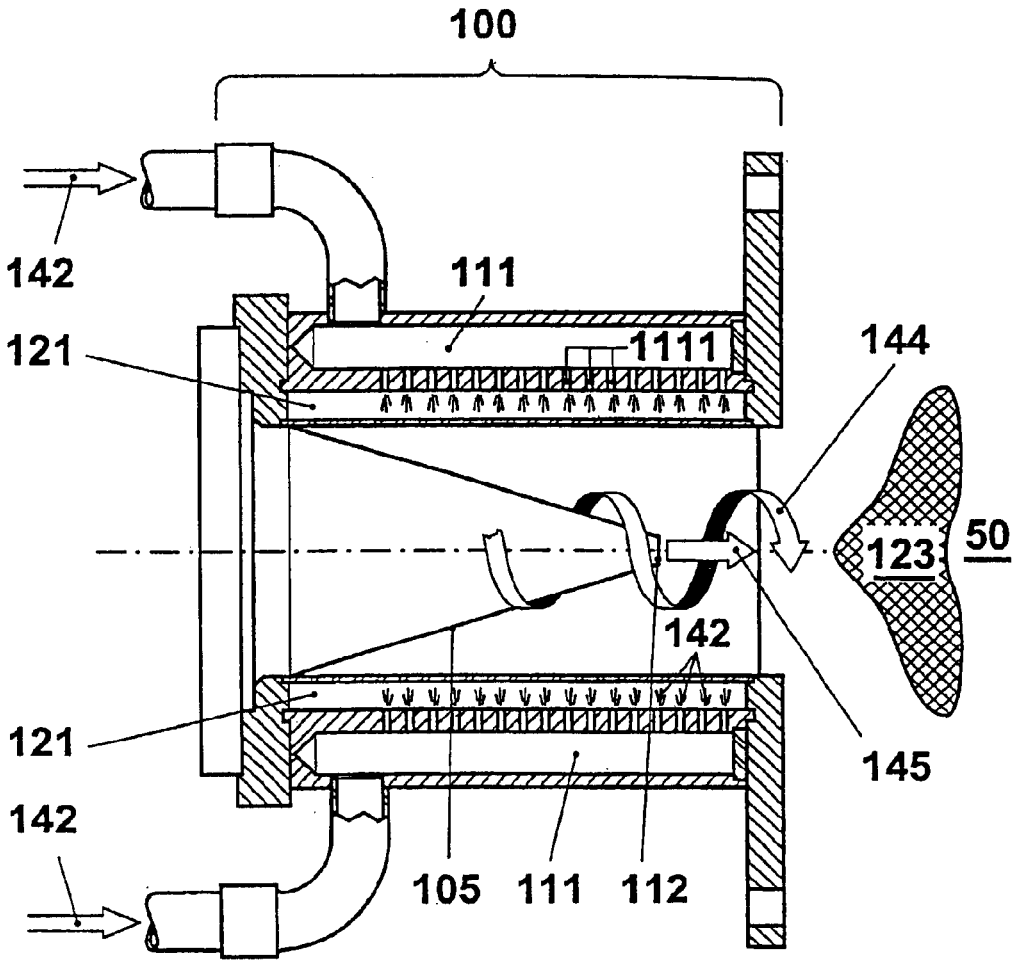
FIG. 9 illustrates a cross-sectional view of yet another embodiment of a burner in accordance with the present invention.
Figure 10:
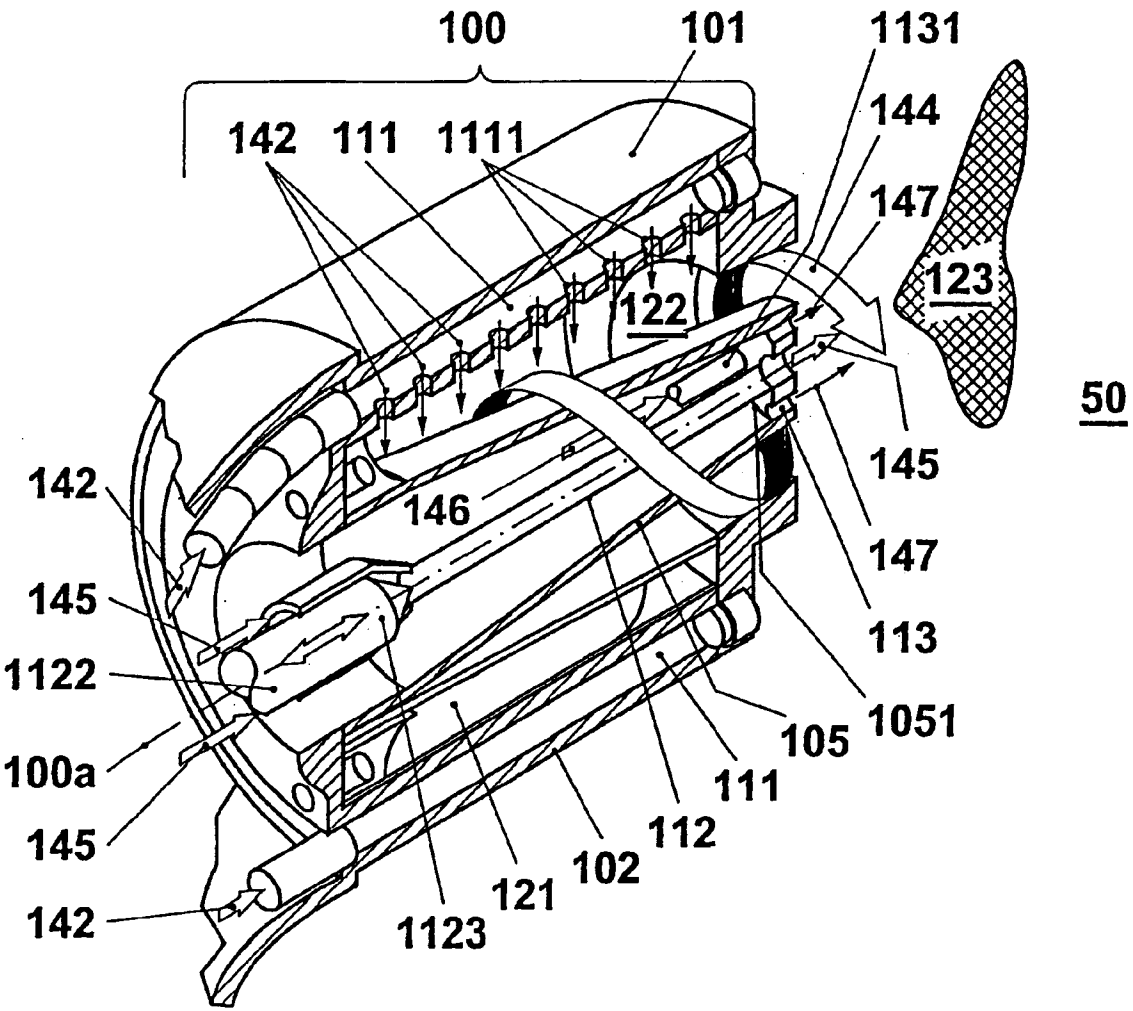
FIG. 10 illustrates a perspective view, with portions broken away, of yet another burner, somewhat similar to the burner illustrated in FIG. 9, in accordance with the present invention.

Burners are likewise known from WO 93/17279 and EP 0 945 677, and have cylindrical swirl generators with tangential combustion air inlets. In this connection it is also known to arrange a displacement member, tapering toward the burner mouth, in the interior of a cylindrical swirl generator. The favorable criterion given above for the axial throughflow cross section of the swirl generator, namely that the axial throughflow cross section increases in the axial throughflow direction, is fulfilled by means of such a swirl generator internal member. Embodiments of such burners are shown in FIGS. 9 and 10. The first embodiment in FIG. 9 shows the principle of such a burner. The mode of operation is sufficiently known and explained in principle in connection with FIG. 1; deviating from the embodiment shown in FIG. 1 of a burner according to the invention, the embodiment shown in FIG. 9 of course has a conical compression member which tapers in the combustion space 50 toward the burner mouth. The injection device 112 for axial central flow 145 is appropriately arranged in the region of the downstream end of this displacement member. The inflow to the injection device 112 can advantageously be arranged in the interior of the displacement member; space is likewise found there for the control means to be associated, according to the invention, with the burner. Furthermore, central fuel injections can of course be arranged here without problems, if required.

FIG. 10 shows in detail such an embodiment of the burner as expressly described in basic form in EP 0 945 677. The displacement member 105 is hollow, and is made blunt at its end toward the combustion space 50. The injection device 112 for the axial central flow is arranged within the hollow displacement body 105, which is open toward the upstream, inflow side of the burner. The mass flow of the axial flow 145 can be changed by means of an axially displaceable central member 1122 with a control cone 1123. The control mechanism proper, with the cone, is here arranged, for space reasons, in the upstream portion of the displacement member internal space. A chamber is arranged in the interior at the downstream end of the displacement member. A fuel duct 1131 leads through the hollow displacement member to this chamber, and a fuel 146 is supplied by it to the chamber. This fuel can flow into the swirled combustion air flow 144 as centrally injected fuel by means of outlet openings 113 acting as central fuel nozzles. The position of the recirculation zone 123 can be matched to the operating conditions of the burner at any given time by the control of the axially introduced mass flow 145 by means of the control cone 1123. Embodiments of the fuel injection and the injection of the axial central flow are of course also aspects of the invention here, in which the fuel is introduced along the burner axis 100*a*, and the injection device for the central flow is arranged annularly, about analogously to the embodiments shown in FIGS. 4 and 5.

The burner can of course also be provided with a cylindrical swirl generator with a mixing section following downstream of the swirl generator, without departing from the present invention.

Figure 11:
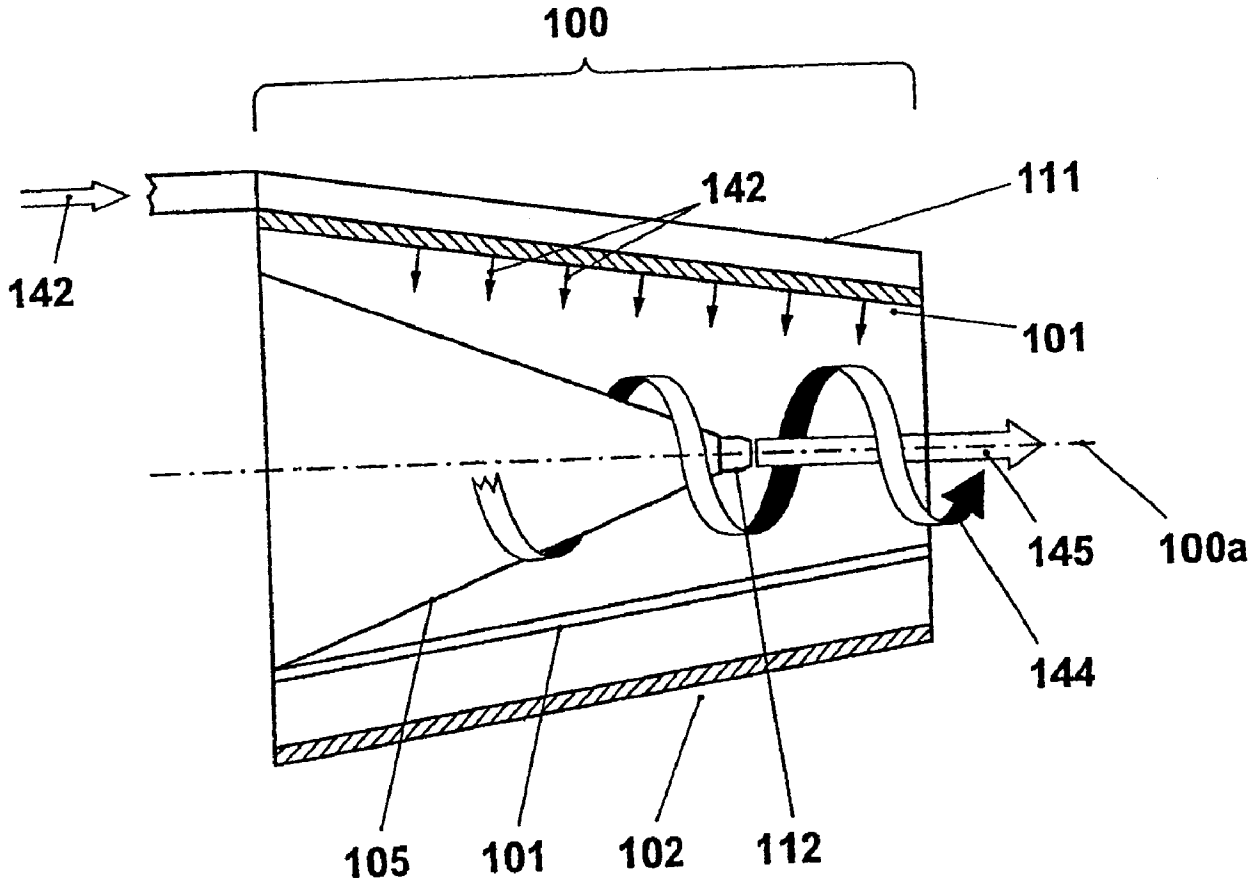
FIG. 11 illustrates a cross-sectional view of yet a further embodiment of a burner in accordance with the present invention.

The use of a swirl generator with a central displacement member also makes it possible to shape the swirl generator itself as convergent to the mouth, but to nevertheless shape the axial throughflow cross section of the swirl generator internal space as divergent. This variant, shown in FIG. 11, makes possible a course of the transverse velocity components of the swirl flow 144 directed toward the burner axis 100*a*. Here also, the central member 105 can with advantage be provided with an injection device 112 for the introduction of a controllable axial central flow.

Figure 12:
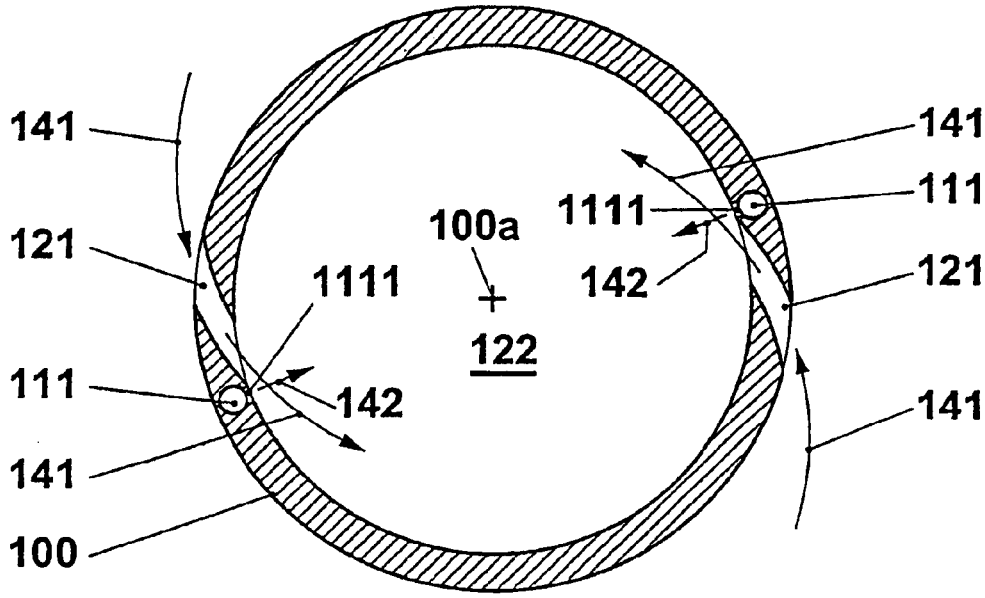
FIG. 12 illustrates a cross-sectional view of still a further embodiment of a burner in accordance with the present invention.
Figure 13:
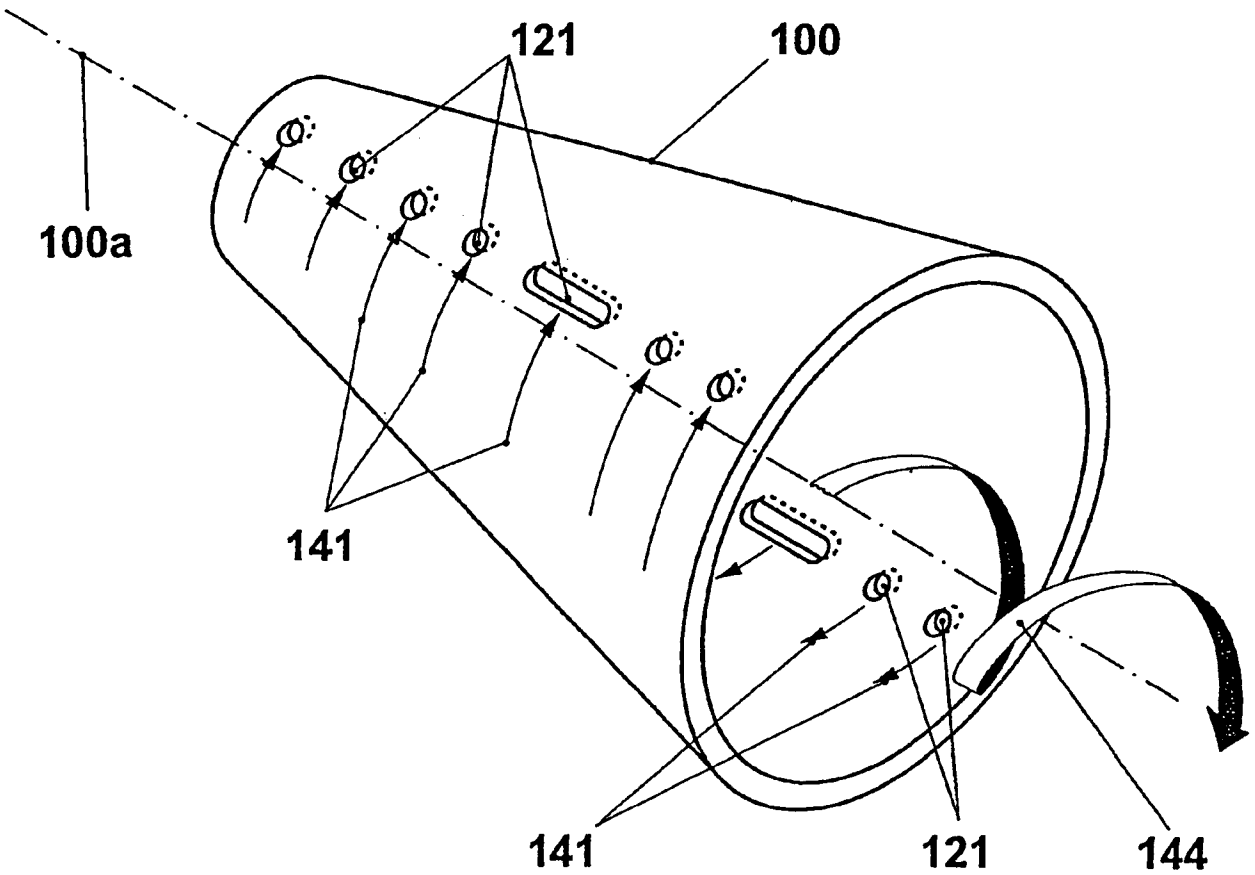
FIG. 13 illustrates a perspective view of again a further embodiment of a burner in accordance with the present invention.

Swirl generators with tangential combustion air inlets can be constructed in different ways. Besides the construction from several partial members shown in cross section in FIGS. 2 and 3, monolithic constructions with inlet openings are also candidates. Such an embodiment is shown in cross section in FIG. 12. The swirl generator is constructed from a hollow cylindrical monolith. In this, inlet openings 121 are machined in the form of slots running axially and tangentially, through which a combustion air flow 141 flows tangentially into the swirl generator interior 122. Fuel ducts 111 can furthermore be seen in the form of bores which run axially and have outlet bores 1111 through which a fuel 142 can flow out into the combustion air flow 141. In FIG. 13, a conical swirl generator 100 with a monolithic hollow body is shown. This could of course also be cylindrical. Tangential openings, bores for example, are machined in the monolithic swirl generator and likewise serve as tangential inlet openings 121 for a combustion air flow 141.

The embodiment examples described hereinabove are in no way to be understood as limiting the present invention. They are on the contrary to be understood as illustrative and as a sketch of the multifarious possible embodiments within the scope of the invention as characterized in the claims.

Preferred methods for the operation of a burner according to the invention will be apparent to the skilled person from the specific use.

Figure 14:
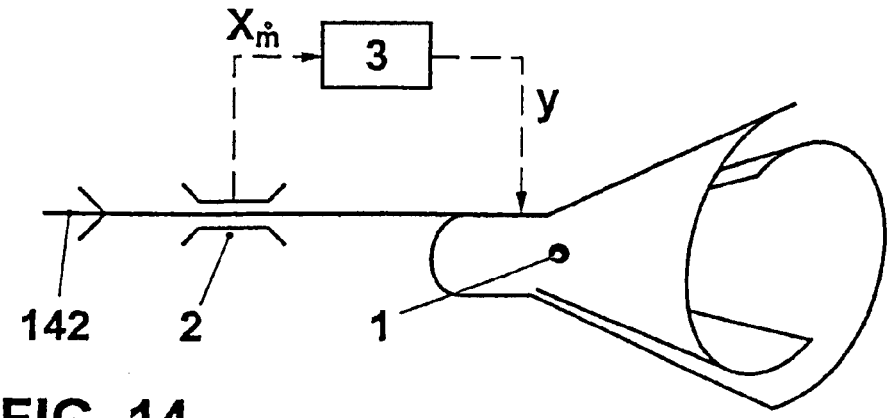
FIG. 14 schematically illustrates a first embodiment of a system and method in accordance with an embodiment of the present invention.

A first method of operation, easy to manipulate, is shown in FIG. 14. The burner 1 is operated with a fuel 142. The mass flow of this fuel is determined at a measurement point 2. The resulting mass flow signal $X_{\dot{m}}$ is processed in a control unit 3, and is converted into a control signal Y for the adjustment mechanism of the axial central air injection of the burner 1.

Figure 15:
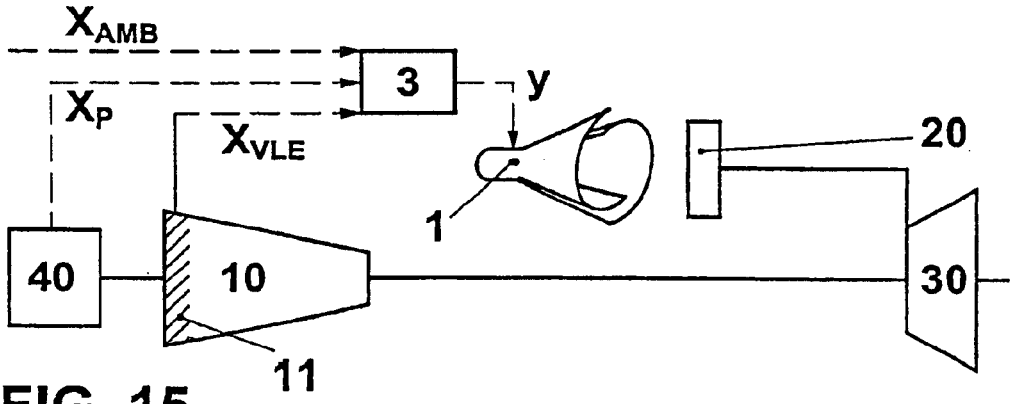
FIG. 15 schematically illustrates a second embodiment of a system and method in accordance with an embodiment of the present invention.

A second embodiment, shown in FIG. 15, concerns the use of the burner according to the invention in gas turbine plants, for which the burner according to the invention is especially suitable. In the example in FIG. 15, a compressor 10, a turbine 30, and a generator 40 are arranged on a common shaft. The compressor 10 is equipped with an adjustable front guide vane set 11. A combustion chamber 20 is arranged in the flow path of a working medium, between the compressor 10 and the turbine 30. The combustion chamber 20 is operated with at least one burner 1 according to the invention. A regulating signal Y is passed from a control unit 3 to the adjustable device for the injection of the axial central flow. In the example shown, the control unit 3 receives a power signal $X_P$, signals $X_{AMB}$ from sensors (not shown) which determine ambient conditions—temperature, moisture, pressure, etc.—of the ambient air, and also a signal $X_{VLE}$ which reproduces the position of the front guide vane set 11. A whole series of further data relevant to machine operation can be passed to the control unit 3; in particular, the generator power signal could be replaced by fuel flow signals. The control unit 3 is capable of forming from these quantities a burner loading specific for combustion air, and to determine the control signal Y from this.

Figure 16:
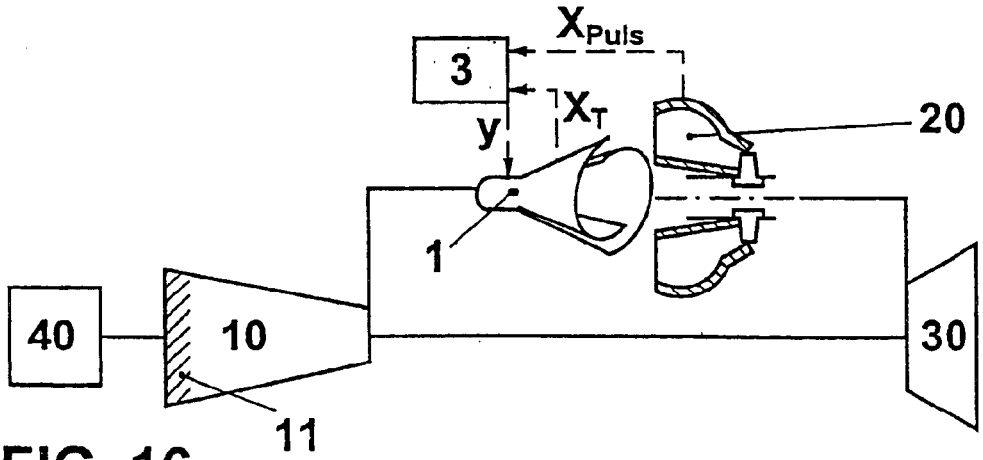
FIG. 16 schematically illustrates a third embodiment of a system and method in accordance with an embodiment of the present invention.

A gas turbine set with a compressor 10, a turbine 30, and a generator 40 arranged on a common shaft is again shown in FIG. 16. The combustion chamber 20 is shown in longitudinal section as an annular combustion chamber which is operated with at least one burner 1 according to the invention. The burner 1 is provided with a temperature measurement point for the determination of the material temperature, producing a temperature signal $X_T$. The combustion chamber 20 is provided with a pulsation measuring device for the determination of the combustion air pressure fluctuations, producing a pulsation signal $X_{Puls}$. The signals $X_T$ and $X_{Puls}$ are passed to a control unit 3 which generates a control signal Y for the control of the intensity of the axial central flow. When the material temperature exceeds a given threshold value, the central injected mass flow is increased so that the flame is driven a little away from the burner mouth, reducing the heat loading of the burner. On the other hand this can lead to an undesired reduction of flame stability. This is determined by the pulsation measuring point. When the pulsation signal $X_{Puls}$ increases, the central injected mass flow can be reduced, in order to increase the stability of combustion and to counter the increase of combustion pressure fluctuations. The central injection can be controlled in this manner in dependence on relevant measured data.

It goes without saying that the given operating processes also represent portions of substantially more complex, superordinate control designs and can be integrated into these.

It is furthermore conceivable to provide only one burner of a multi-burner system with the central air supply according to the invention, or to operate the burners with different central air flows. Symmetry-breaking can thereby be attained in a targeted manner in multi-burner systems, and can be used for the reduction or complete prevention of, in particular, azimuthal acoustic vibrations.

The statements hereinabove serve to the skilled person as illustrative examples for the numerous possible embodiments of the burner according to the invention characterized in the claims, and for their advantageous manner of operation.

While the invention has been described in detail with reference to preferred embodiments thereof, it will be apparent to one skilled in the art that various changes can be made, and equivalents employed, without departing from the scope of the invention. Each of the aforementioned documents is incorporated by reference herein in its entirety.

What we claim is:

1. A process for the operation of a burner, comprising the steps of:

providing a burner for a heat generator, the burner including a swirl generator for receiving and swirling at least part of a combustion air flow, the swirl generator defining a central burner axis and having an internal space, the swirl generator configured and arranged for tangentially introducing the combustion air flow into the internal space, the internal space defining a cross sectional throughflow area;

providing means for the introduction of at least one fuel into the combustion air flow, means at a downstream end of the swirl generator for forming an abrupt widening of the cross sectional throughflow area, and an injection device configured and arranged for the introduction of an axial central air flow along the central burner axis, the injection device including an adjustable element configured and arranged for altering a throughflow cross section of the injection device and for the control of the mass flow of the axial central air flow; and controlling the axial central air mass flow, thereby controlling an axial position of a recirculation zone, in (i) strongly throttling the axial central air mass flow at low burner load, and (ii) weakly throttling or no throttling of the axial central air mass flow at high burner load.

2. The process in accordance with claim 1, further comprising the step of: determining the burner load using a fuel mass flow measurement signal $X_{\dot{m}}$.

3. The process in accordance with claim 1, further comprising the steps of:

operating the burner in a combustion chamber of a gas turbine plant; and wherein determining the burner load comprises determining the burner load based on a parameter selected from the group consisting of:

(a) the generator power;

(b) a fuel of the gas turbine plant;

(c) the setting of a front guide vane set of a compressor belonging to the gas turbine plant;

(d) ambient conditions; and (e) combinations thereof.

4. The process according to claim 1, wherein a material temperature of the burner is measured, and wherein the axial central air mass flow is controlled in dependence on the measured material temperature.

5. The process according to claim 1 in a combustion chamber of a gas turbine plant, wherein combustion pulsations are measured, and wherein the axial central air mass flow is controlled in dependence on the measured combustion pulsations.

6. The process according to claim 1 in a multi-burner system of a gas turbine, wherein combustion pulses are measured and the central flow of individual burners is controlled in dependence on the measured combustion pulsations.

7. The process according to claim 1, wherein the axial central air mass flow is not throttled at the high burner load.

8. The process according to claim 1, wherein the axial central air mass flow is weakly throttled at the high burner load.

* * * * *